US009242460B2

(12) United States Patent
Omata et al.

(10) Patent No.: US 9,242,460 B2
(45) Date of Patent: Jan. 26, 2016

(54) LIQUID-DISCHARGE-HEAD SUBSTRATE, METHOD OF MANUFACTURING THE SAME, AND LIQUID DISCHARGE HEAD

(75) Inventors: Koichi Omata, Kawasaki (JP); Yoshiyuki Imanaka, Kawasaki (JP); Takaaki Yamaguchi, Yokohama (JP); Yuuji Tamaru, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/548,581

(22) Filed: Aug. 27, 2009

(65) Prior Publication Data

US 2010/0053278 A1 Mar. 4, 2010

(30) Foreign Application Priority Data

Aug. 29, 2008 (JP) ..... 2008-221494

(51) Int. Cl.

| | |
|---|---|
| ***B41J 2/05*** | (2006.01) |
| ***B41J 2/14*** | (2006.01) |
| ***B41J 2/045*** | (2006.01) |
| ***B41J 2/16*** | (2006.01) |

(52) U.S. Cl.

CPC ..... *B41J 2/14072* (2013.01); *B41J 2/0458* (2013.01); *B41J 2/04528* (2013.01); *B41J 2/04531* (2013.01); *B41J 2/04543* (2013.01); *B41J 2/14129* (2013.01); *B41J 2/1603* (2013.01); *B41J 2/1626* (2013.01); *B41J 2/1631* (2013.01); *B41J 2/1642* (2013.01); *B41J 2/1646* (2013.01)

(58) Field of Classification Search

USPC ..... 347/63; 216/17

See application file for complete search history.

(56) References Cited

U.S. PATENT DOCUMENTS

| | | | | |
|---|---|---|---|---|
| 4,847,630 | A * | 7/1989 | Bhaskar et al. | 347/63 |
| 5,841,448 | A * | 11/1998 | Moriyama et al. | 347/19 |
| 5,943,070 | A | 8/1999 | Kamiyama et al. | |
| 6,231,167 | B1 * | 5/2001 | Tsuboi et al. | 347/65 |
| 6,293,655 | B1 * | 9/2001 | Imanaka et al. | 347/65 |
| 6,315,396 | B1 | 11/2001 | Ozaki et al. | |
| 6,471,339 | B1 | 10/2002 | Kamiyama et al. | |
| 2003/0090533 | A1 * | 5/2003 | Imanaka et al. | 347/9 |
| 2006/0017774 | A1 | 1/2006 | Beak | |
| 2006/0139383 | A1 * | 6/2006 | Hayasaki | 347/5 |
| 2006/0181578 | A1 * | 8/2006 | Iijima | 347/62 |
| 2009/0033719 | A1 | 2/2009 | Saikawa et al. | |
| 2010/0053278 | A1 * | 3/2010 | Omata et al. | 347/63 |
| 2010/0283819 | A1 * | 11/2010 | Tamaru et al. | 347/65 |

FOREIGN PATENT DOCUMENTS

| | | | | |
|---|---|---|---|---|
| CN | 1104151 | A | 6/1995 | |
| CN | 1724257 | A | 1/2006 | |
| EP | 1621347 | | 2/2006 | |
| EP | 2159059 | A1 * | 3/2010 | B41J 2/14 |
| JP | 3-005151 | | 1/1991 | |
| JP | 03-246046 | | 11/1991 | |
| KR | 10-0757861 | B1 | 9/2007 | |

* cited by examiner

*Primary Examiner* — Juanita D Jackson

(74) *Attorney, Agent, or Firm* — Canon USA, Inc., IP Division

(57) ABSTRACT

A method of manufacturing a liquid-discharge-head substrate is provided, which includes a plurality of elements for discharging liquid, and a heating member for heating the liquid-discharge-head substrate, the method including the steps of preparing a substrate having an insulating layer made of an insulating material provided on or above the substrate, providing a conductive layer made of a conductive material, and forming a conductive line being configured to supply current for driving the element and a part of a heating member by using the conductive layer.

12 Claims, 18 Drawing Sheets

| INPUT ORDER | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| CONTENT | DATA 0 | DATA 1 | DATA 2 | DATA 3 | DATA 4 | DATA 5 | DATA 6 | DATA 7 | DATA 8 | DATA 9 | DATA 10 | DATA 11 | DATA 12 | DATA 13 | DATA 14 | DATA 15 | BE0 | BE1 | BE2 | BE3 |

LIQUID-DISCHARGE-HEAD SUBSTRATE, METHOD OF MANUFACTURING THE SAME, AND LIQUID DISCHARGE HEAD

BACKGROUND OF THE INVENTION

1. Field of the Invention

The present invention relates to a liquid-discharge-head substrate, a method of manufacturing the liquid-discharge-head substrate, and a liquid discharge head.

2. Description of the Related Art

A typical thermal type liquid discharge head (hereinafter, also referred to as head) includes a liquid-discharge-head substrate (hereinafter, also referred to as head substrate) having a liquid discharge heater and a conductive layer for electrical connection, and a member having a discharge port which corresponds to the heater and discharges liquid.

In recent years, functions for stabilizing discharge of liquid are added to a head substrate. One of the functions is obtained by a technique of pre-heating the head substrate by a heating member (hereinafter, also referred to as sub-heater) provided at the substrate, in addition to a heating element for liquid discharge (hereinafter, also referred to as heater).

As such a sub-heater, for example, Japanese Patent Laid-Open No. 3-005151 discloses a structure in which a heater and a sub-heater are formed of a conductive layer. The sub-heater heats a head substrate to prevent a discharge characteristic from being degraded at a low temperature.

Meanwhile, a head substrate increases in size as the number of heating elements increases. Also, when the number of colors of inks increases, the number of supply ports increases, resulting in the size of the head substrate increasing. Hence, in related art, variation in temperature distribution may likely appear in the head substrate when the head substrate is pre-heated.

When the variation in temperature distribution in the head substrate increases, discharge characteristics such as a discharge amount and a discharge speed of ink droplets may vary among a plurality of nozzles. This may cause density unevenness and disorder of landing points of the ink droplets. Recording quality may be degraded.

In particular, when pre-heating is performed before a recording operation, the temperature of the head substrate has to be quickly increased to a predetermined temperature. Owing to this, power to be applied to the sub-heater is increased. A large temperature gradient may appear in the head substrate between a position close to the sub-heater and a position far from the sub-heater.

In addition, when pre-heating is performed to keep the temperature of the head at a predetermined temperature during a recording operation, a temperature gradient may increase as the temperature of the head substrate is set high. This may degrade recording quality.

SUMMARY OF THE INVENTION

Accordingly, the present invention provides a head substrate and a head capable of decreasing variation in temperature distribution in the head substrate, and increasing recording quality with a simple structure.

Also, the present invention provides a method of easily manufacturing such a head substrate with a reduced process load.

According to an aspect of the present invention, a method of manufacturing a liquid-discharge-head substrate is provided. The substrate has an element, the element being configured to generate thermal energy for discharging liquid. The method includes the steps of preparing a substrate having an insulating layer on or above a surface of the substrate, the insulating layer being made of an insulating material; providing a conductive layer on or above the insulating layer, the conductive layer made of a conductive material; and, forming a conductive line and a heating member by using the conductive layer, the conductive line being configured to supply current for driving the element, and the heating member being electrically separated from the conductive line and configured to generate heat for heating the liquid-discharge-head substrate.

With the aspect, a head substrate is provided, which can decrease the variation in temperature distribution in the head substrate and increase the recording quality. In addition, a manufacturing method is provided, which easily provides the above-mentioned head substrate.

Further features of the present invention will become apparent from the following description of exemplary embodiments with reference to the attached drawings.

DESCRIPTION OF THE EMBODIMENTS

Figure 3:
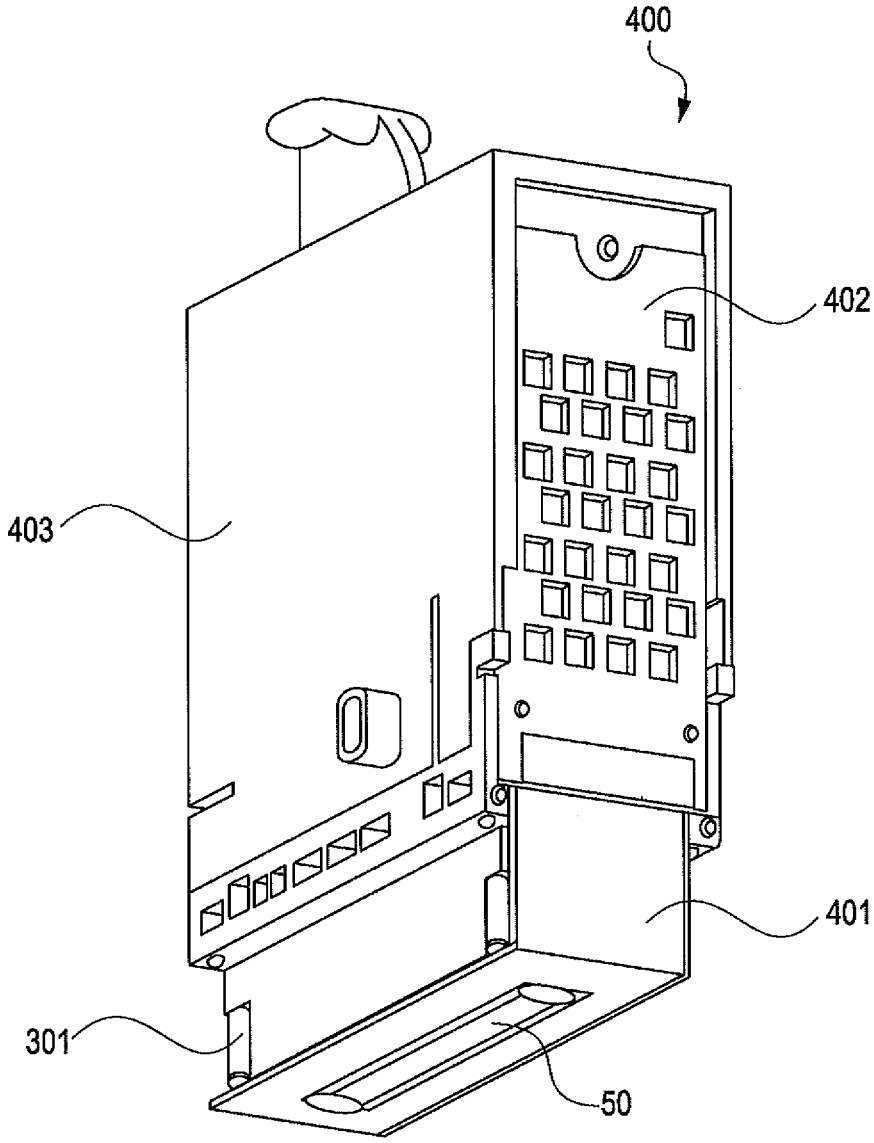
FIG. 3 is a general view showing an example head applied to the present invention.

FIG. 3 is a perspective view showing an example of a liquid discharge head unit according to an embodiment. Referring to FIG. 3, a head unit 400 includes a liquid discharge head (hereinafter, referred to as head) having two long supply ports. Each supply port has a recording width of 0.85 inch.

First, a liquid discharge (inkjet) device will be briefly described.

Figure 1:
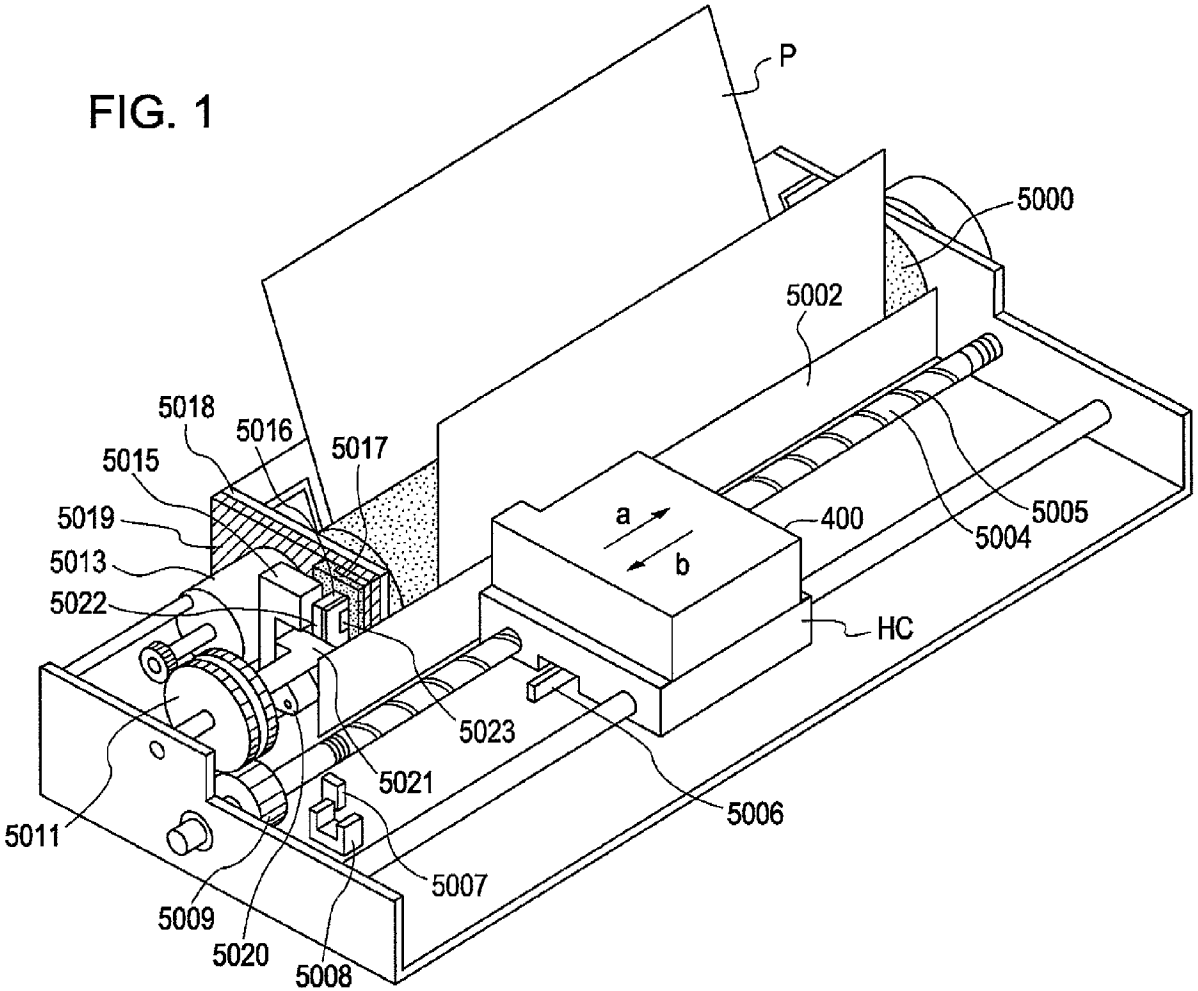
FIG. 1 briefly illustrates a liquid discharge device.

FIG. 1 briefly illustrates the liquid discharge device applicable to the present invention. Referring to FIG. 1, a lead screw 5004 rotates in association with normal rotation and inverse rotation of a drive motor 5013 through driving force transmission gears 5011 and 5009. A carriage HC has a pin (not shown) engaging with a spiral groove 5005 of the lead screw 5004. When the lead screw 5004 rotates, the carriage HC reciprocates in directions indicated by arrows a and b. A head unit 400 is mounted on the carriage HC.

A sheet pressure plate 5002 presses a recording sheet P against a platen 5000 over a moving direction of the carriage HC. Photosensors 5007 and 5008 are home position detecting elements which detect a lever 5006 of the carriage HC in a detection area and changes a rotating direction of the drive motor 5013. A cap 5022 covers a front surface of the head unit 400 in an airtight manner. The cap 5022 is supported by a support member 5016. A sucking member 5015 sucks the cap 5022 for a sucking and recovery operation of the head unit 400 through a cap opening 5023. A cleaning blade 5017 and a member 5019 are supported by a body support plate 5018. The member 5019 allows the cleaning blade 5017 to move in a front-rear direction. The cleaning blade 5017 is not limited to one described above. Any of typical cleaning blades can be applied to this embodiment. A lever 5021 starts sucking of the sucking and recovery operation. The lever 5021 is moved when a cam 5020 engaging with the carriage HC moves. The lever 5021 is moved by the driving force from the drive motor and controlled through a transmission mechanism such as a clutch.

The operations of capping, cleaning, and sucking and recovery are performed at corresponding positions when the carriage HC is moved to an area at a home position by the lead screw 5004. As long as desired operations are performed at proper timings, this embodiment can be applied to any configuration.

Figure 2:
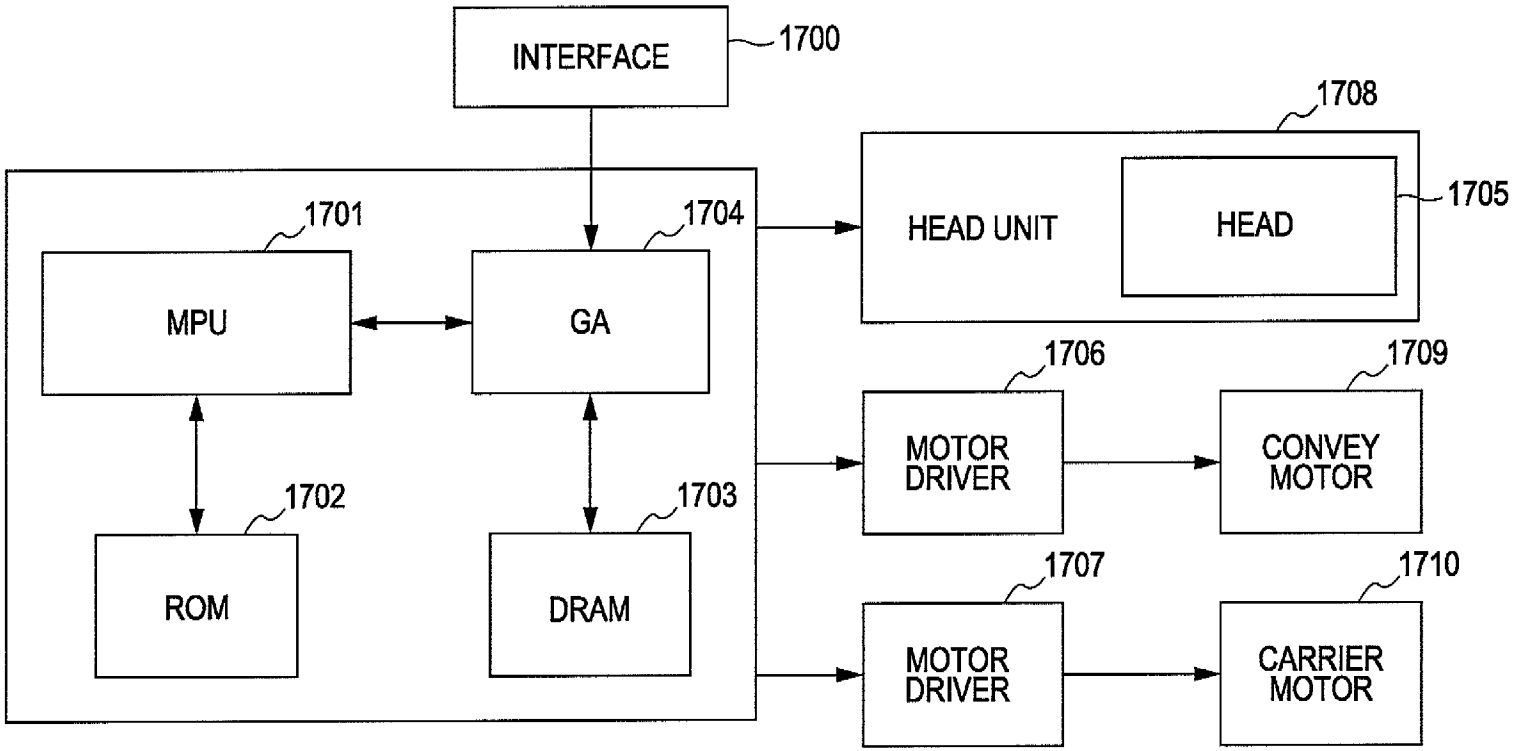
FIG. 2 is a block diagram showing a control configuration of the liquid discharge device.

Next, a control circuit section for controlling a recording operation of the liquid discharge device will be described with reference to a block diagram of FIG. 2. Referring to FIG. 2, the control circuit section has an interface 1700 to which a recording signal is input. Also, the control circuit section includes a MPU 1701, a program ROM 1702 which stores a control program executed by the MPU 1701, and a dynamic RAM (DRAM) 1703 which stores a recording signal and various data such as recording data supplied to a head unit 1708. Further, the control circuit section includes a gate array (GA) 1704 which controls supply of recording data for the head unit 1708. The control circuit section supplies a signal for driving the head unit 1708 through the GA 1704. The GA 1704 also controls data transmission among the interface 1700, the MPU 1701, and the DRAM 1703.

The control circuit section is electrically connected to a carrier motor 1710 which carries the head unit 1708, and to a convey motor 1709 which conveys a recording sheet. The control circuit section drives the convey motor 1709 and the carrier motor 1710 through motor drivers 1706 and 1707. A head 1705 is provided at the head unit 1708. The head 1705 has a discharge heater (hereinafter, also referred to as heater) serving as an element for generating thermal energy to discharge liquid, and a drive circuit for driving the heater.

An operation of the above-mentioned control configuration is described. When a recording signal is input to the interface 1700, the recording signal is converted into recording data for printing through the GA 1704 and the MPU 1701. Then, the motor drivers 1706 and 1707 are driven, and the heater is driven in accordance with the recording data sent to the head 1705 of the head unit 1708. Hence, recording is performed.

Next, the head unit 400 will be described with reference to FIG. 3.

Referring to FIG. 3, a head 50 is bonded to a support body 301 made of alumina, and is attached to a sub-tank 403. A signal line and a power line to the head 50 are connected to a printed wiring board 402 through a tape automated bonding (TAB) line 401. The printed wiring board 402 has a contact pad. The contact pad is electrically connected to a connector of the carriage.

Figure 4:
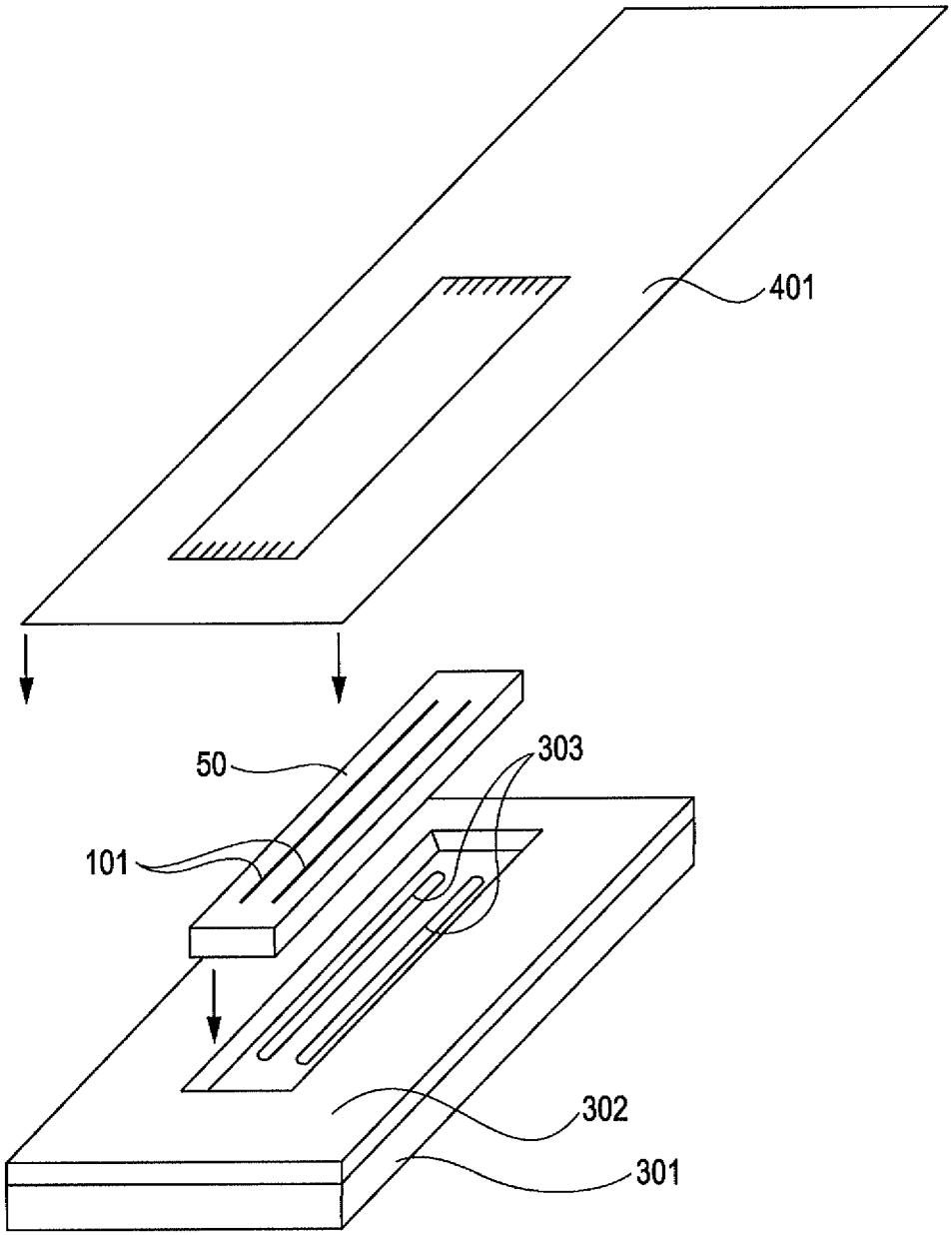
FIG. 4 is an exploded perspective view showing the order of a mounting process of an example head substrate applied to the present invention.
Figure 8:
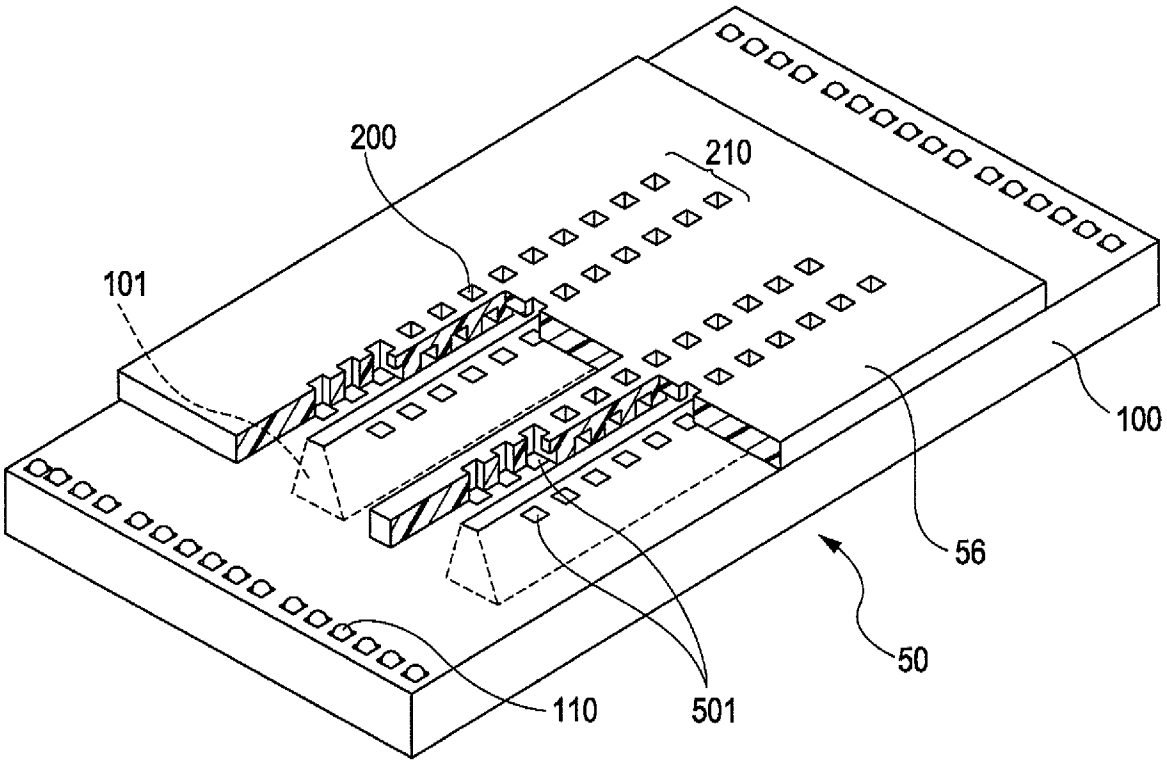
FIG. 8 is a perspective view showing an example head.

FIG. 4 is an exploded perspective view specifically showing a bonding portion between the head 50 and the support body 301. FIG. 8 is a perspective view showing a head applicable to the configuration in FIG. 4.

Referring to FIG. 4, the support body 301 has a second support body 302 which is previously bonded to the support body 301. Supply portions 303 penetrate through the support body 301 at two positions. A surface of the support body 301 opposite to the head 50 is joined to the sub-tank 403, to communicate with the inside of the sub-tank 403 through the supply portions 303. The second support body 302 equalizes the surface height of the head 50 and the surface height of the second support body 302, to provide easy connection between an inner lead of the TAB line 401 and pads of the head 50.

The head 50 is bonded to the support body 301 by die bonding, the TAB line 401 is bonded on the second support body 302, and the inner lead of the TAB line 401 is connected to the pads of the head 50. Then, the support body 301 is jointed to the sub-tank 403, to connect the TAB line 401 to the printed wiring board 402. The printed wiring board 402 is fixed to the sub-tank 403 by caulking. Thusly, the head unit 400 is completed.

The head 50 includes a liquid-discharge-head substrate (hereinafter, also referred to as head substrate) 100 having supply ports 101 which are long through holes and heaters 501, and a member 56 to provide a wall for forming an ink path. The supply ports 101, or the long through holes, are formed in a silicon substrate. An array of the heaters 501 are provided on either side of each supply port 101. The heaters 501 generate energy for liquid discharge. Further, each heater 501 is connected to an electric line for power supply. The electric line is electrically connected to the outside through external connection pads 110 provided at the head substrate 100. The member 56 having discharge port arrays 210 is provided on the head substrate 100. Each discharge port array 210 has a plurality of discharge ports 200. The member 56 has the discharge ports 200 at positions facing the heaters 501.

First Embodiment

Figure 5:
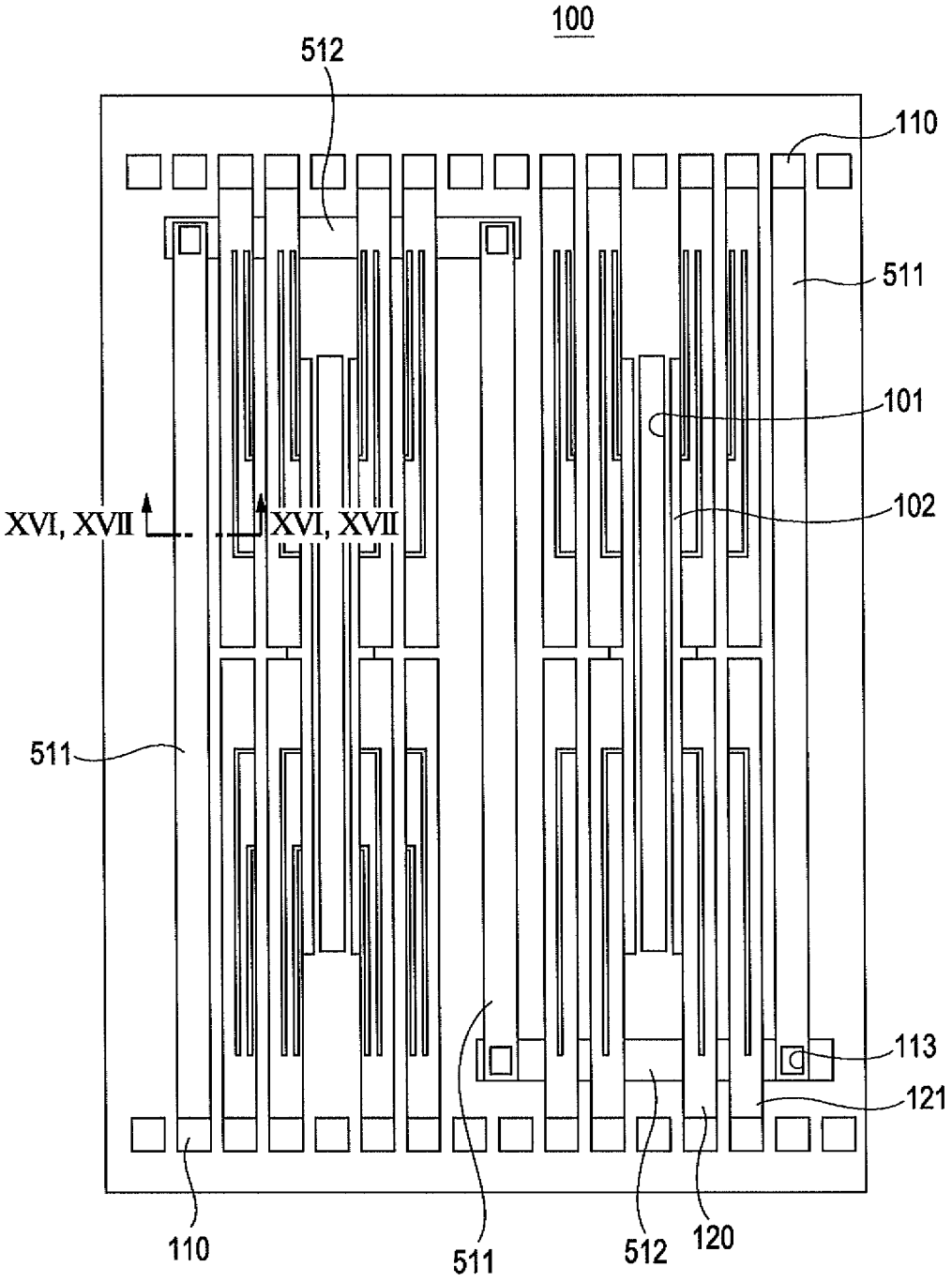
FIG. 5 is a plan view showing a layout of a conductive layer of a head substrate according to a first embodiment.
Figure 6:
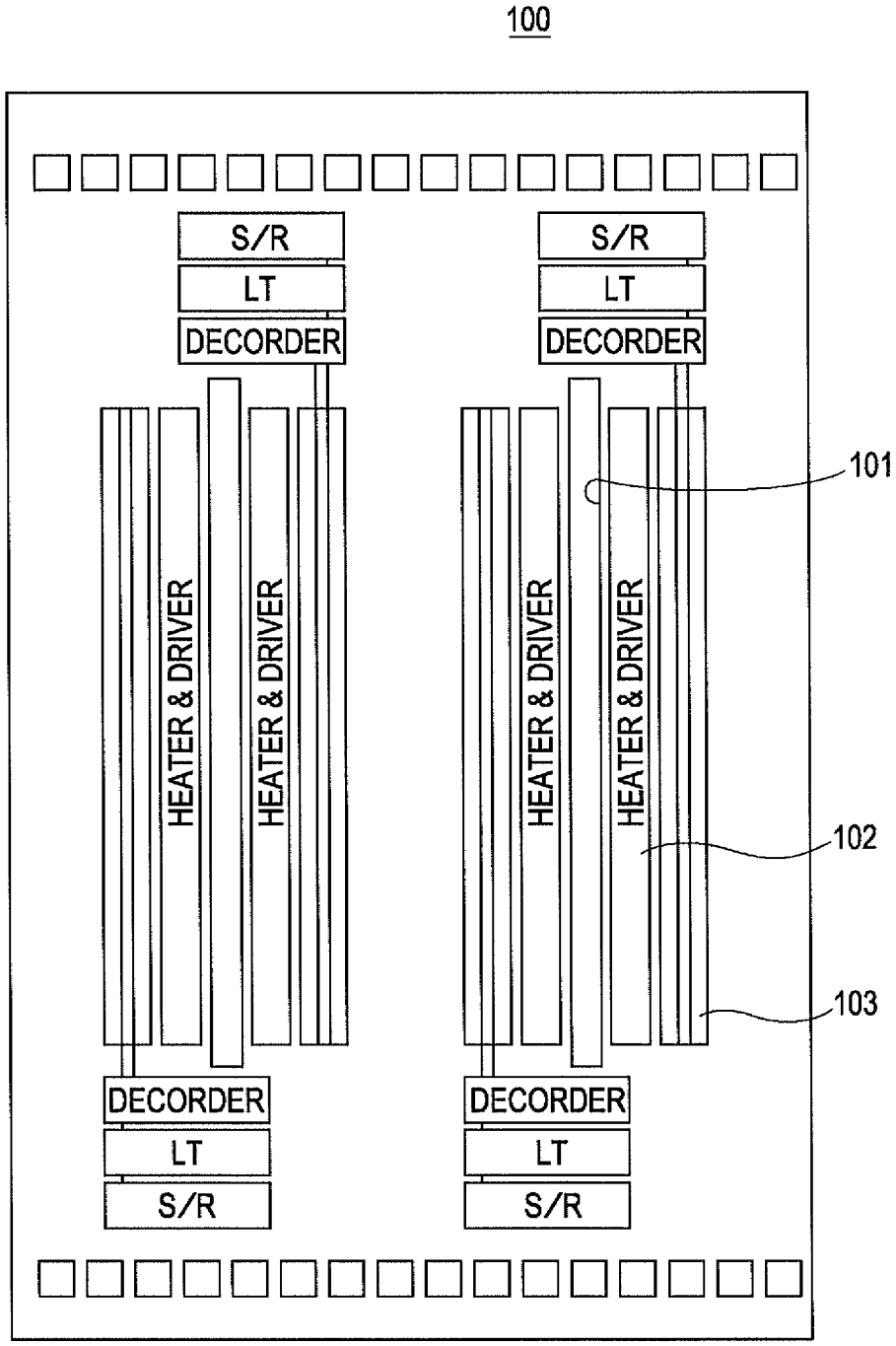
FIG. 6 is a plan view showing a layout of a first conductive layer of a head substrate according to the first embodiment.
Figure 7:
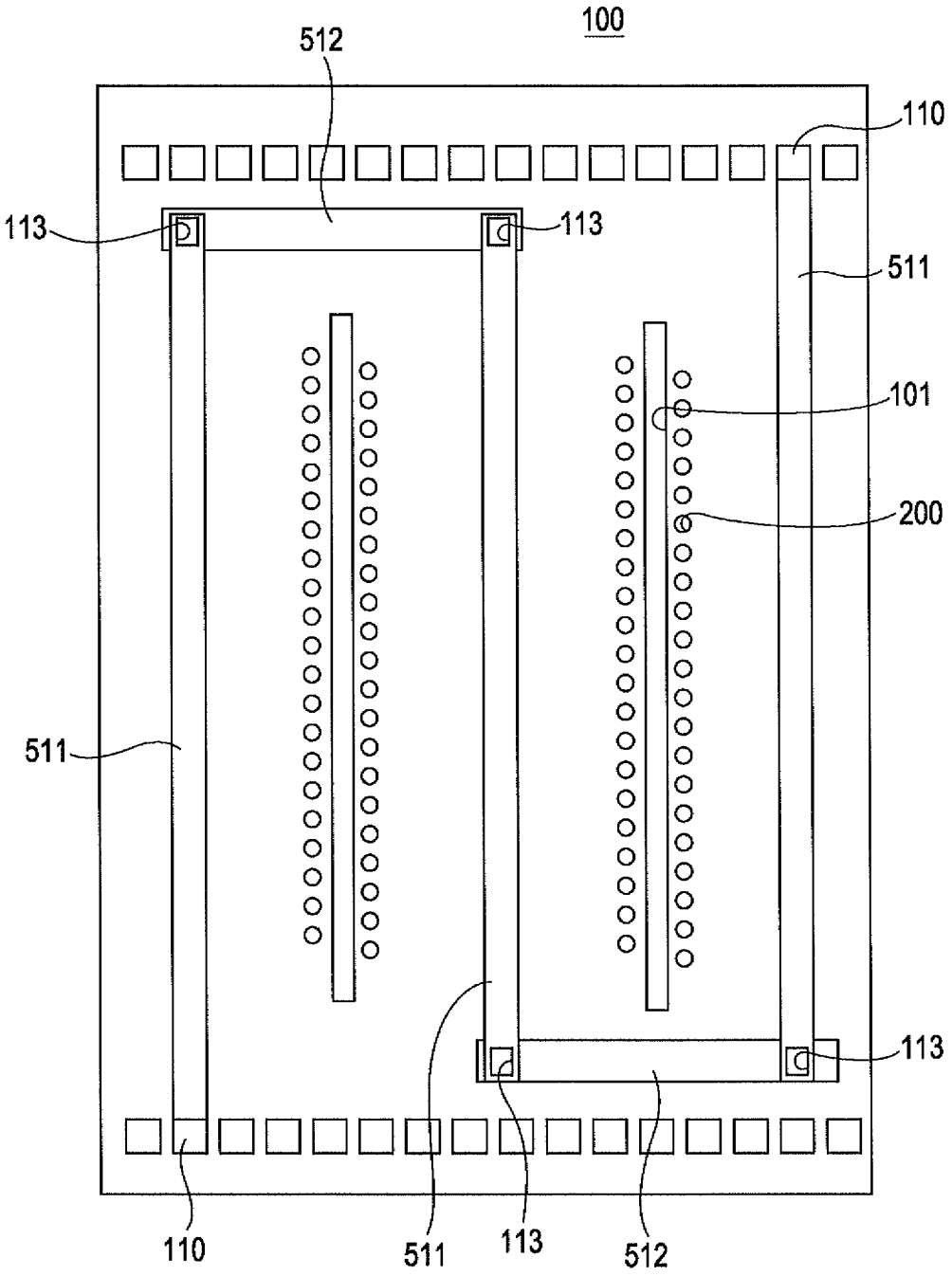
FIG. 7 illustrates a relationship between sub-heaters and nozzles shown in FIG. 5.

FIG. 5 is a plan view showing a layout mainly for a second conductive layer which forms a conductive line for power supply to the plurality of heaters. FIG. 6 is a plan view showing a layout mainly for a first conductive layer which forms a drive circuit line connected mainly to a drive circuit. FIG. 7 is a plan view showing a relationship in the head, between a portion used for a sub-heater serving as a heating member which pre-heats the liquid-discharge-head substrate, and nozzles which discharge liquid.

Referring to FIGS. 5, 6, and 7, the head substrate 100 has the two long supply ports 101 arranged such that longitudinal directions of the supply ports 101 are parallel to each other. The supply ports 101 penetrate through the head substrate 100 in a thickness direction thereof. Referring to FIG. 6, a discharge heater array 102 (element arrays) including a plurality of discharge heaters, and a driver array including a plurality of drivers serving as switching elements for the discharge heaters are arranged along the longitudinal direction of opening edges of the supply ports 101. Drive circuits and a drive circuit line 103 are arranged opposite to the supply port 101 with respect to the discharge heater array 102. The drive circuits including an AND circuit output signals to the driver section. The drive circuit line 103 is connected to the drive circuits.

A conductive line for connecting elements of the drive circuits, and the drive circuit line 103 are formed of the first conductive layer made of, for example, aluminium. The first conductive layer is provided above a surface of the head substrate 100 in a direction perpendicular to the surface, at which the driver section and the elements (e.g., AND circuit) used for the drive circuits are provided. A part of the first conductive layer functions as sub-heaters 512, which are formed of the first conductive layer. The sub-heaters 512 are arranged in a direction orthogonal to the discharge heater array 102.

A wiring line formed of the second conductive layer is provided above the surface of the head substrate 100 formed of the first conductive layer in the direction perpendicular to the surface, with an insulating layer interposed therebetween. VH power lines 120 and GNDH power lines 121 are provided above the driver section in the direction perpendicular to the surface of the head substrate 100. The VH power lines 120 and the GNDH power lines 121 are formed of the second conductive layer and supply power to the plurality of heaters. In addition, referring to FIG. 5, long sub-heaters 511 are formed of the second conductive layer, and extend in the longitudinal direction of the supply ports (i.e., along the element array provided along the supply ports), in an area between the adjacent supply ports and areas between the supply ports and edges of the head substrate 100. It is to be noted that the GNDH power lines 121 formed of the second conductive layer may be arranged on a part of the drive circuits and the drive circuit line 103.

Referring to FIGS. 5 and 7, the member 56 having the discharge ports 200 is formed of a resin member. The member 56 is provided above the discharge heater array 102 in the direction perpendicular to the surface of the head substrate 100. FIG. 8 is a perspective view showing the head. Referring to FIG. 8, the member 56, formed of resin and having the discharge ports 200 corresponding to the discharge heaters 501, is provided above the discharge heaters 501. Liquid heated by the discharge heaters 501 is discharged from the discharge ports 200, and hence, a recording operation is performed.

Next, a method of driving the discharge heater will be described.

Figure 9:
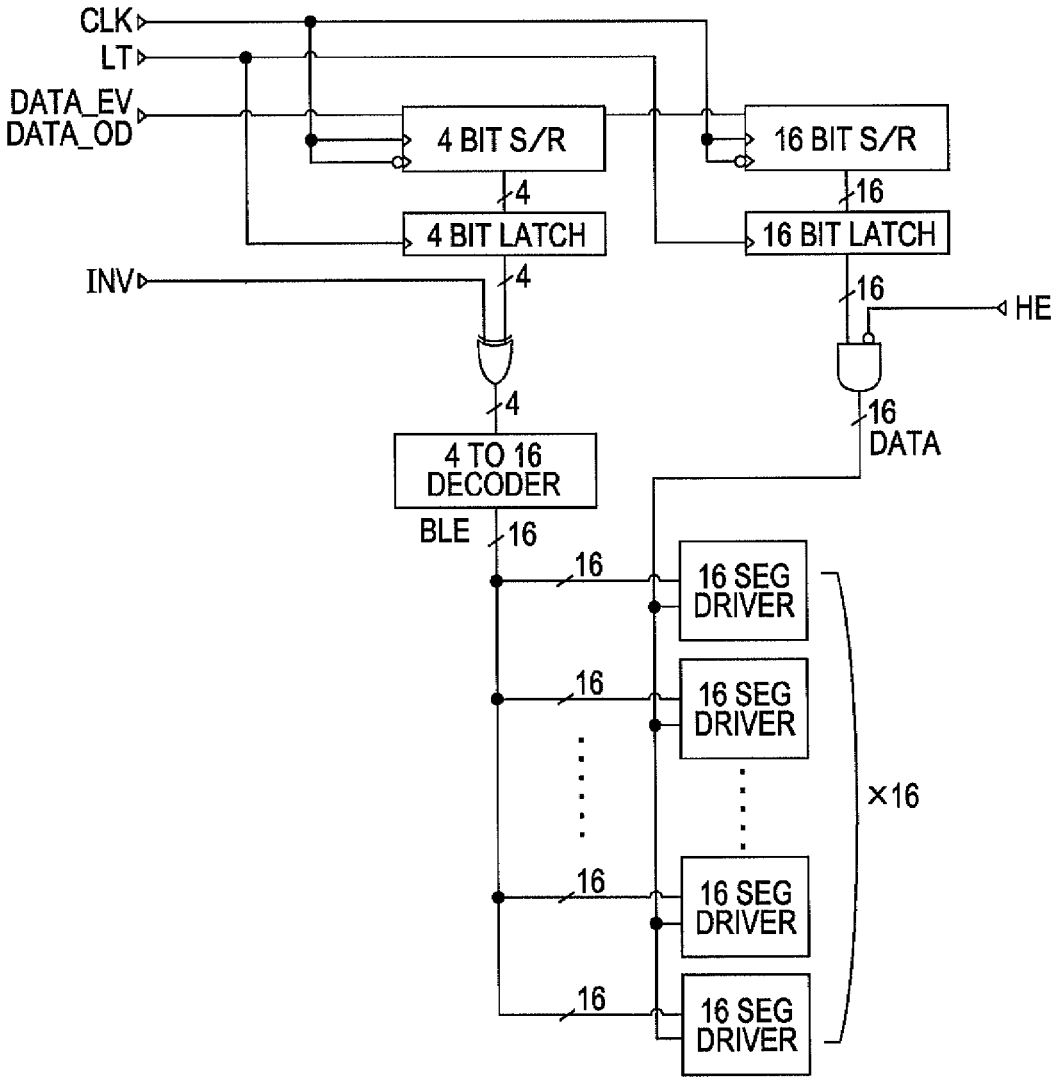
FIG. 9 is a circuit block diagram at one supply port of the head substrate applied to the present invention.

FIG. 9 is a block diagram of a circuit for driving the discharge heaters arranged at one end in a short-side direction of each supply port 101. At the one end in the short-side direction of the supply port 101, 256 discharge heaters are arranged. Assuming that 16 discharge heaters define a single block, all discharge heaters are divided into 16 blocks. Time-division driving is used for driving of the discharge heaters. In the time-division driving, a driving timing is changed for every block.

Figures 10A, 10B:
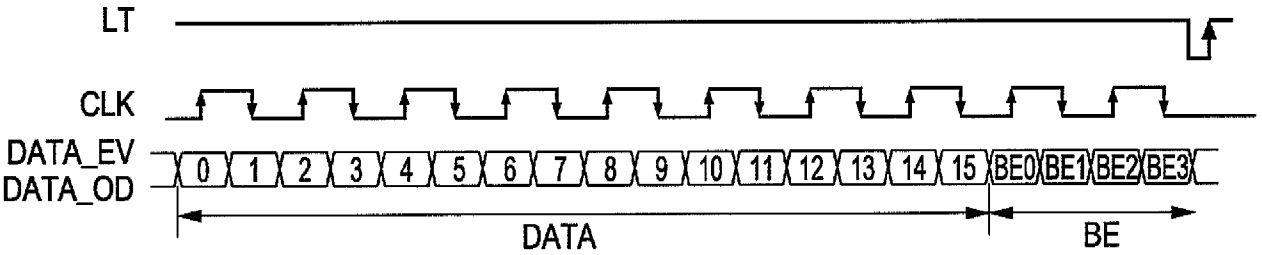
FIGS. 10A and 10B illustrate the order and content of DATA signals.

Referring to FIGS. 10A and 10B, data of 20 bits is input to DATA_EV or DATA_OD, and the data enters S/R. First 16 bits correspond to a DATA signal for selecting one of the adjacent discharge heaters in the array to be driven. The DATA signal is any of DATA0 to DATA15. Residual 4 bits correspond to a BE signal. The BE signal generates a block selection signal BLE for selecting one of the blocks. The 4 bits of BE0 to BE3 are decoded into 16 time-division signals of BLE0 to BLE15.

Figure 11:
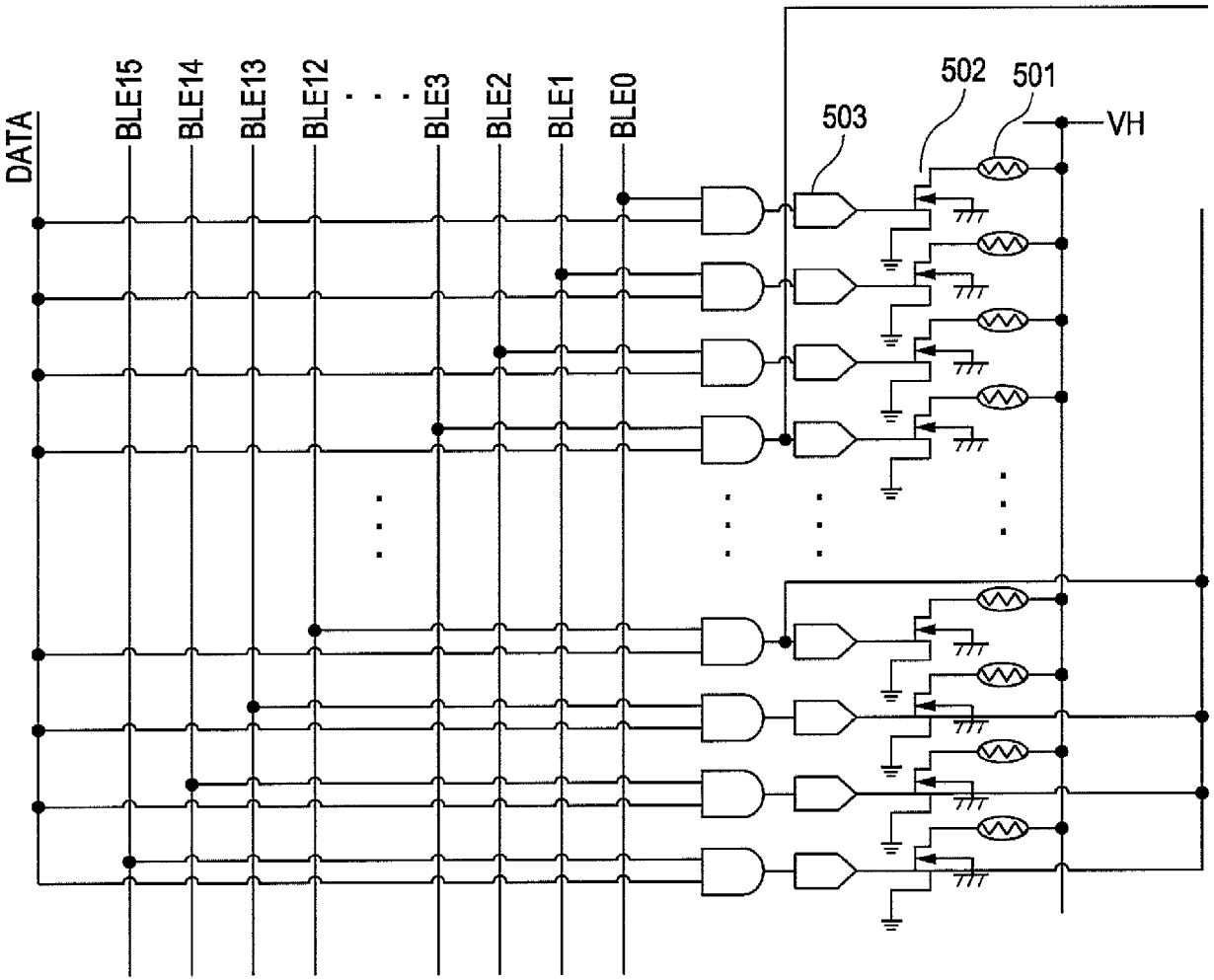
FIG. 11 is a circuit diagram showing an equivalent circuit of a driver section.

FIG. 11 is an equivalent circuit of the driver section. Referring to FIG. 11, one of DATA0 to DATA15 is input as the DATA signal. The signals of BLE0 to BLE15 are sequentially respectively connected to the AND circuits provided correspondingly to the discharge heaters. The DATA signal and the BLE signal are input simultaneously. A signal output from the AND circuit drives a driver transistor 502 which is used as a switching element by boosting with a booster circuit 503. When the driver transistor 502 is driven, power is supplied to the discharge heater 501, and hence the discharge heater 501 is driven.

Next, reliability of the sub-heater is described.

When a part of a wiring line is used as a sub-heater by supplying high current to aluminium, which is typically used for a conductive layer, electromigration resistance has to be considered.

Electromigration (hereinafter, also referred to as EM) is a phenomenon in which atoms of aluminium of the wiring line move in a flow direction of electrons when current is supplied to the wiring line. As a result, voids may be generated and surface defects, such as hillocks and whiskers, may appear.

A mean time to failure of the head substrate due to EM relies on Black's empirical equation. Referring to Black's empirical equation, the mean time to failure is generally inversely proportional to a current density to the n-th power (n is normally 2). That is, when the wiring line is used as the sub-heater, the current density has to be a predetermined value or lower for the head substrate to have a sufficiently long life regarding EM. Black's Empirical Equation (1) is as follows:

$$\mathrm{MTTF}=A\times J^{-n}\times e^{Ea/kT} \quad (1),$$

where MTTF is a mean time to failure (hours), A is a constant determined depending on a structure and a material of a wiring line, J is a current density ($A/cm^2$), n is a constant representing a dependency of current density, normally 2, depending on a temperature gradient, an acceleration condition, etc., Ea is an activation energy (eV), normally ranging from 0.4 to 0.7 eV, depending on an orientation, a particle diameter, a protection film, etc., k is Boltzmann constant, i.e., $8.616\times10^{-5}$ eV/K, and T is an absolute temperature (K) of the wiring line.

To use the wiring line as the sub-heater, power consumption of a certain value or higher is necessary. To secure a longer life regarding EM while heat is generated with a necessary power consumption, in particular to decrease the current density while keeping a constant voltage-current, both the length and cross-sectional area of the wiring line have to be increased. For example, when the length of the wiring line is doubled and the cross-sectional area of the wiring line is doubled, a resistance of the wiring line for forming the sub-heater is not changed, and hence, the power consumption is not changed. The current density, however, can be halved. Regarding Black's empirical equation, a mean time to failure due to EM can be substantially quadrupled.

As described above, to secure a reasonable life regarding EM, the sub-heater has to have a suitable length of the wiring line and a suitable cross-sectional area of the wiring line. In addition, to perform pre-heating with an even temperature distribution, the wiring line for the sub-heater should be arranged as evenly as possible within a plane of the head substrate.

To secure the proper length of the wiring line for the sub-heater and to arrange the wiring line substantially evenly in the head substrate, the sub-heater can be formed of a plurality of conductive layers. For example, when a head substrate is a thermal type, the head substrate typically includes a heater line for power supply to a heater, and a logic line used for a drive circuit for driving the heater. In such a head substrate, a second conductive layer for the heater line and a first conductive layer for the logic line are used. Hence, the sub-heater is efficiently arranged to extend continuously through an area not occupied by the two supply ports as shown in FIGS. 5 to 7. With this arrangement, pre-heating can be performed at an even temperature distribution.

Now, an example method of manufacturing the head substrate according to the embodiment will be described with reference to FIGS. 16A to 16E. FIGS. 16A to 16E illustrate a method of manufacturing a head substrate corresponding to a cross section taken along line XVI-XVI in FIG. 5.

Figure 16A:
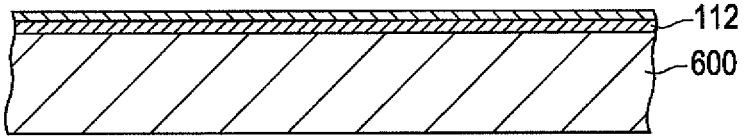
FIGS. 16A to 16E illustrate an example method of manufacturing a head substrate applied to the present invention.
Figure 16B:
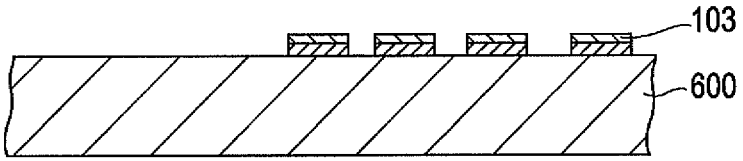
Figure 16C:
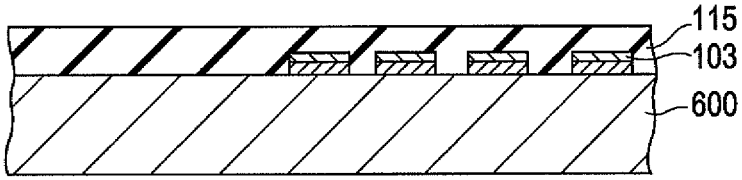
Figure 16D:
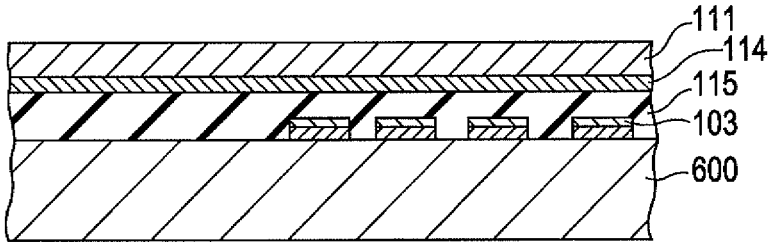
Figure 16E:
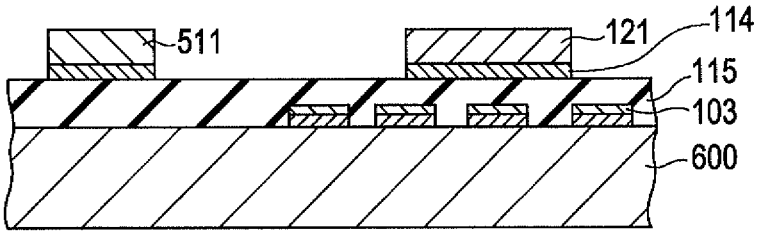

A substrate 600 made of silicon and having a driver section and elements for drive circuits including an AND circuit is prepared. A material, for example, aluminium is provided on the substrate by sputtering or the like, so that a first conductive layer 112 is made by a conductive material, for example, Al—Cu (FIG. 16A). A resist is applied on the first conductive layer 112, patterning is performed by photolithography etc., and etching is performed. Accordingly, a wiring line for connection of the elements of the drive circuits, a drive circuit line 103 for transmission of a logic signal such as a recording data signal or a block signal to the AND circuit, and a part of the sub-heater, are formed of the first conductive layer (FIG. 16B). An insulating layer 115 made of silicon oxide or the like is provided on the above structure by chemical vapor deposition (CVD) etc. (FIG. 16C). A resist is applied on the insulating layer 115, patterning is performed by photolithography etc., and etching is performed. Accordingly, an opening is made in the insulating layer 115 for a connection portion. Further, a resistance layer 114 made of, for example, TaSiN or WSiN, and a second conductive layer 111 made of a material such as Al are provided on the above structure (FIG. 16D). Similarly to the first conductive layer 112, patterning of the resistance layer 114 and a second conductive layer is performed to provide VH power lines 120 and GNDH power lines 121 for power supply to a plurality of heaters, and sub-heaters 511 are provided (FIG. 16E).

Figure 18:
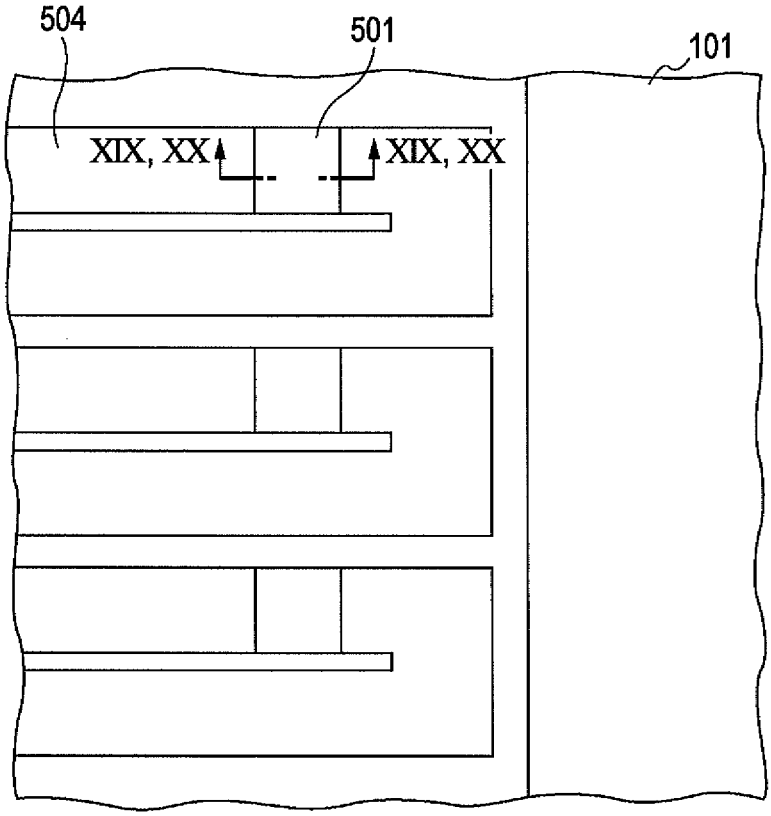
FIG. 18 schematically illustrates a discharge heater.

FIG. 18 is a schematic illustration in which a part of the discharge heater 501 is illustrated in an enlarged manner. The discharge heater 501 is provided along the longitudinal direction of the ink supply port. The discharge heater 501 is electrically connected to an individual line 504 formed of the second conductive layer for power supply.

Figure 19A:
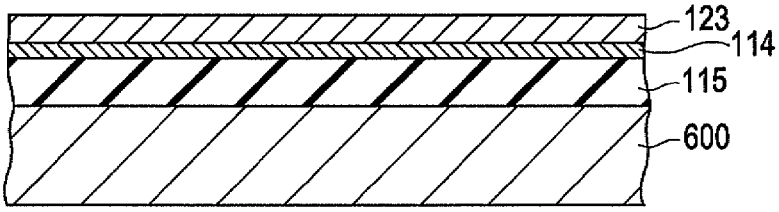
FIGS. 19A and 19B illustrate an example method of manufacturing a head substrate applied to the present invention.
Figure 19B:
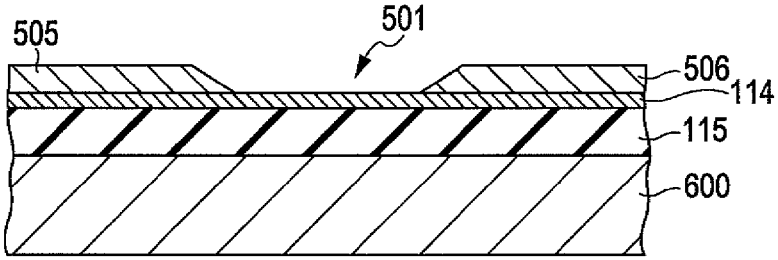

FIGS. 19A and 19B illustrate a method of manufacturing a discharge heater 501 corresponding to a cross section taken along line XIX-XIX in FIG. 18. A part of the individual line 504 of a second conductive layer 123 which is in contact with the resistance layer 114 is removed from the substrate provided according to the manufacturing method in FIGS. 16A to 16E. Hence, the individual line 504 is divided into a first line portion 505 and a second line portion 506 which is separated from the first line portion 505. A part of the resistance layer 114 at a position between the first and second line portions 505 and 506 serves as the discharge heater 501 for liquid discharge.

Next, a structure of sub-heaters shown in FIG. 7 is described in more detail. The sub-heaters for heating the substrate include sub-heaters 512 made of the first conductive layer and sub-heaters 511 made of the insulating layer, the resistance layer, and the second conductive layer. The sub-heaters 512 and 511 are stacked on one another in that order from the head substrate 100. Further, openings 113 are formed in the insulating layer in areas where planes of the sub-heaters 512 and 511 overlap. The sub-heaters 512 of the first conductive layer and the sub-heaters 511 of the second conductive layer are electrically connected to each other in the openings 113. Such electric connection portions are called connection portions. The sub-heaters 512 of the first conductive layer and the sub-heaters 511 of the second conductive layer are electrically connected with each other through the connection portions.

Figure 17A:
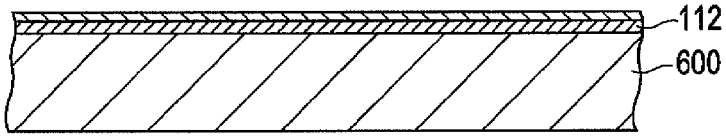
FIGS. 17A to 17E illustrate an example method of manufacturing a head substrate applied to the present invention.
Figure 17B:
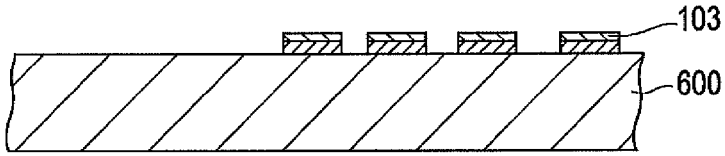
Figure 17C:
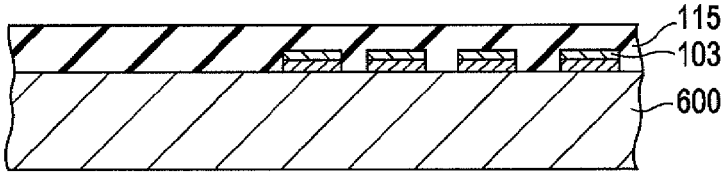
Figure 17D:
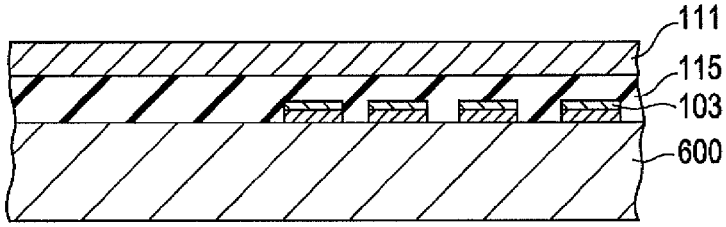
Figure 17E:
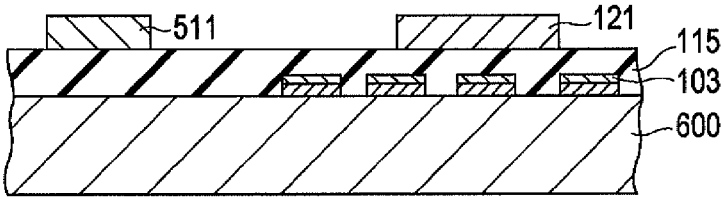
Figure 20A:
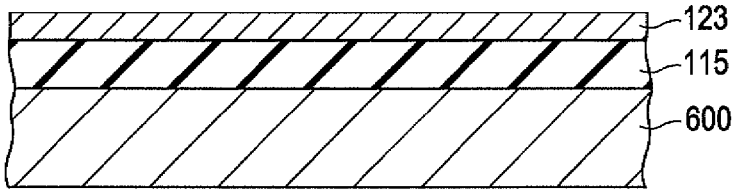
FIGS. 20A to 20C illustrate an example method of manufacturing a head substrate applied to the present invention.
Figure 20B:
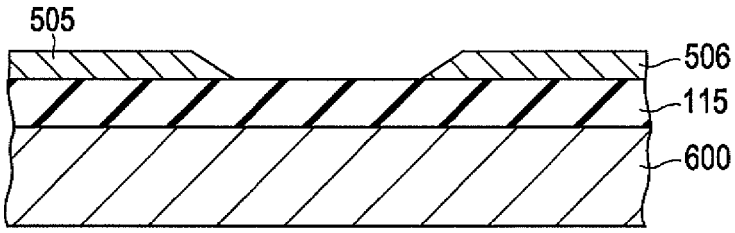
Figure 20C:
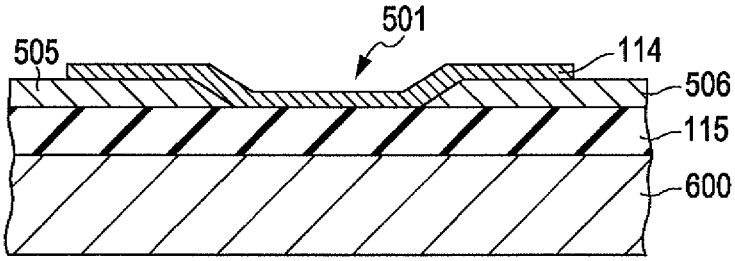

In the embodiment, the resistance layer 114 is arranged between the insulating layer 115 and the individual line 504 formed of the second conductive layer 123. However, the resistance layer 114 may be provided on a wiring line as shown in FIGS. 17A to 17E and FIGS. 20A to 20C. FIGS. 17A to 17E illustrate an method of manufacturing a head substrate 100 corresponding to a cross section taken along line XVII-XVII in FIG. 5. A procedure until the insulating layer 115 is provided is similar to the procedure in the case where the resistance layer 114 is provided between the insulating layer 115 and the individual line 504 formed of the second conductive layer 123 (FIGS. 17A to 17C). The resist is applied on the insulating layer 115, patterning is performed by photolithography etc., and etching is performed. Accordingly, openings used for the connection portions are formed in the insulating layer 115. Further, the second conductive layer 111 formed of Al etc. is provided on the above structure (FIG. 17D). Similarly to the first conductive layer, patterning of the second conductive layer 123 is performed to provide VH power lines 120 and GNDH power lines 121 for power supply to a plurality of heaters, and sub-heaters 511 are provided (FIG. 17E). FIGS. 20A to 20C illustrate an method of manufacturing a discharge heater 501 corresponding to a cross section taken along line XX-XX in FIG. 18. A part of the individual line 504 formed of a second conductive layer 123 provided on the insulating layer 115 is removed. Hence, the individual line 504 is divided into a first line portion 505 and a second line portion 506 which is separated from the first line portion 505. Then, a resistance layer 114 is provided from a position on the insulating layer 115 between the first and second line portions 505 and 506 to positions on the first and second line portions 505 and 506. A part of the resistance layer 114 at the position between the first and second line portions 505 and 506 serves as a discharge heater 501 for liquid discharge.

When a substrate temperature is a predetermined temperature or lower, a voltage is applied from the external connection pad 110 through the inner lead of the TAB line 401 and hence current is supplied. The current flows to the sub-heater 511, the connection portion, the sub-heater 512, the connection portion, and the sub-heater 511, . . . , in that order, and flows to another external connection pad 110. As a result, the sub-heaters generate heat, and increase the substrate temperature to a predetermined temperature. After the substrate temperature is increased, application of the voltage to the sub-heaters is decreased, and is controlled to keep the substrate temperature constant.

As described above, in this embodiment, the sub-heaters are provided in the area between the two adjacent supply ports 101 and areas between the supply ports 101 and the edges of the head substrate 100. With this configuration, the head substrate 100 can be evenly pre-heated in the array direction of the heaters formed by the discharge heater array 102. Further, with this configuration, the proper width and length of the wiring line can be easily provided to decrease the current density of the sub-heaters. Hence, reliability of the sub-heaters can be increased.

With the sub-heaters as described above, the temperature distribution in the substrate can be evenly kept in the array direction of the heaters. Thus, discharge characteristic of liquid (ink) can be equalized, and recording quality can be increased.

Second Embodiment

The inventors studied a case where high durability is demanded because of pre-heating with further high current and because of long-term use of a head.

In a typical head substrate, a heater conductive layer and a resistance layer are stacked. An area contacting the resistance layer and not occupied by the heater conductive layer is used as a heater.

The heater may employ a configuration in which the second conductive layer 111 in FIG. 13A (the second conductive layer 123, in FIG. 19A) is provided above the resistance layer 114, or a configuration in which the second conductive layer 111 in FIG. 13B (the second conductive layer 123, in FIG. 20A) is provided below the resistance layer 114.

Figure 13A:
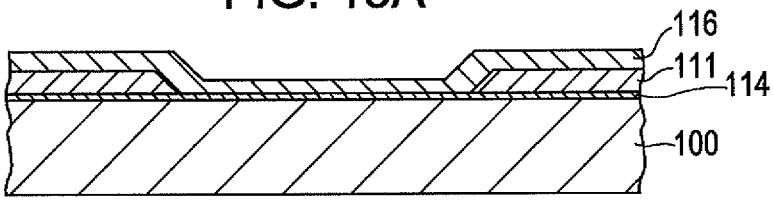
FIGS. 13A to 13D are cross-sectional views showing a discharge heater.
Figure 13B:
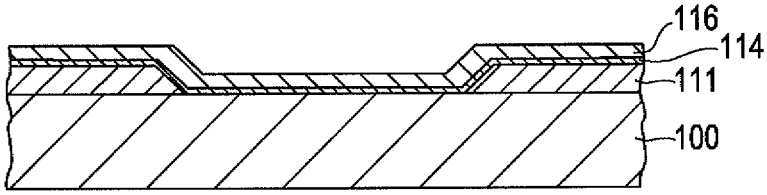

In the configuration of FIG. 13A, the resistance layer 114 and the second conductive layer 111 are successively provided, and etching is performed only at heater portions of the second conductive layer 111. Accordingly, the heaters can be precisely formed.

EM endurance testing was performed for the sub-heater shown in FIG. 13A for a long period. Consequently, it was found that a connection portion between the conductive layers has a lower EM durability than that of a line portion. In particular, an EM durability of a connection portion where electrons flow from the first conductive layer through the resistance layer to the second conductive layer is lower than an EM durability of a connection portion where electrons flow from the second conductive layer through the resistance layer to the first conductive layer.

Figure 13C:
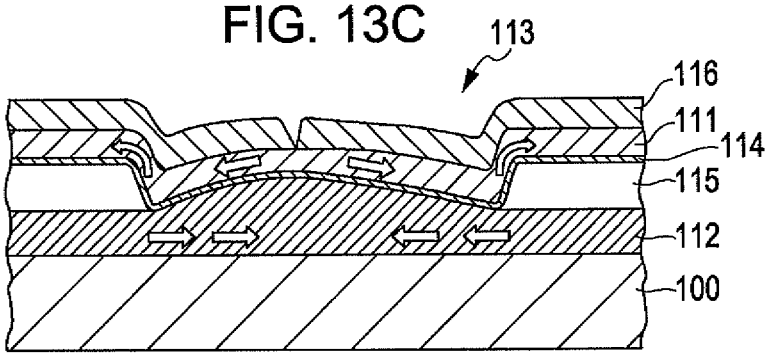
Figure 13D:
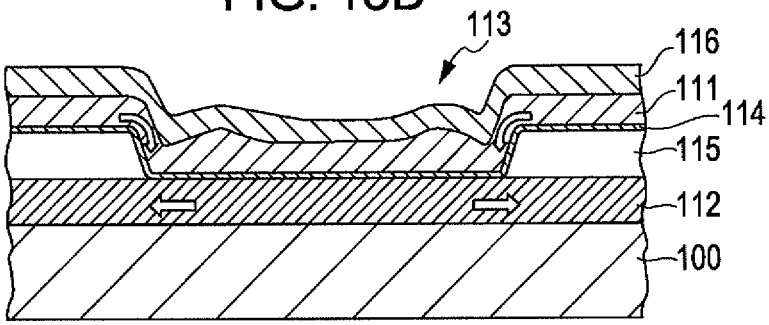

FIGS. 13C and 13D are cross-sectional views showing study samples of the sub-heater with the configuration in FIG. 13A for the study of the EM durability. In the study samples, the second conductive layer 111 is formed of Al—Cu, the resistance layer 114 is formed of TaSiN or WSiN, the insulating layer 115 is formed of P—SiO, and the first conductive layer 112 is formed of Al—Si. In addition, SiN is stacked as a protective layer 116 on the second conductive layer 111. The protective layer 116 has a protecting function to prevent liquid from entering the wiring line of the sub-heater.

Arrows in FIGS. 13C and 13D show directions of electrons flowing in the respective conductive layers. In FIG. 13C, electrons flow from the first conductive layer 112 to the second conductive layer 111. In FIG. 13D, electrons flow from the second conductive layer 111 to the first conductive layer 112.

Here, the connection portion (FIG. 13D) where electrons flow from the second conductive layer 111 through the resistance layer 114 to the first conductive layer 112 is compared with the connection portion (FIG. 13C) where electrons flow from the first conductive layer 112 through the resistance layer 114 to the second conductive layer 111. The connection portion where electrons flow from the first conductive layer 112 to the second conductive layer 111 has a larger hillock of the first conductive layer 112 at a center portion of the connection portion as compared with that of the connection portion where electrons flow from the second conductive layer 111 to the first conductive layer 112. Hence, a crack appears at the protective layer 116 at the connection portion of the first and second conductive layers 112 and 111.

A typical semiconductor element is sealed with resin. Hence, although a slight crack appears at the protective layer, the crack does not cause a serious damage. However, in the case of the head substrate, liquid is present on the surface of the substrate. Hence, if a crack appears at a protective layer, the liquid may enter the crack, resulting in the wiring line being corroded, or disconnected.

In contrast, in the connection portion in FIG. 13D, a slight hillock appears at the second conductive layer 111, however, deformation of the second conductive layer 111 does not cause a serious damage of the protective layer 116.

At the connection portion where electrons flow from the first conductive layer 112 to the second conductive layer 111, the electrons flow from four sides to the center portion of the connection portion, and hence, Al atoms of the first conductive layer 112 attempt to move toward the center portion of the connection portion. However, since the resistance layer 114 is provided, the Al atoms cannot move or be dispersed to the upper side. The Al atoms are collected at the center portion of the connection portion, and a hillock appears.

In contrast, at the connection portion where electrons flow from the second conductive layer 111 through the resistance layer 114 to the first conductive layer 112, the current density becomes highest at a step portion of the second conductive layer 111. Owing to this, the second conductive layer 111 is deformed at a portion close to the four sides of the connection portion. However, electrons are less likely to flow toward the center portion of the connection portion. Hence, a large hillock tends not to appear at the center portion of the connection portion.

As mentioned above, the sub-heater formed of the first conductive layer, the resistance layer, and the second conductive layer has a bottleneck of having a lower EM durability at the connection portion between the conductive layers as compared with an EM durability of the line portion. In particular, the EM durability of the connection portion where electrons flow from the first conductive layer through the resistance layer to the second conductive layer may be lower than the EM durability of the connection portion where electrons flow from the second conductive layer through the resistance layer to the first conductive layer.

Regarding Black's empirical equation, the mean time to failure due to EM is inversely proportional to a current density to the 2nd power. Hence, to increase the EM durability at the connection portion, the area of the connection portion has to be increased. However, the increase in area of the connection portion may cause an increase in size of the head substrate.

Figure 12:
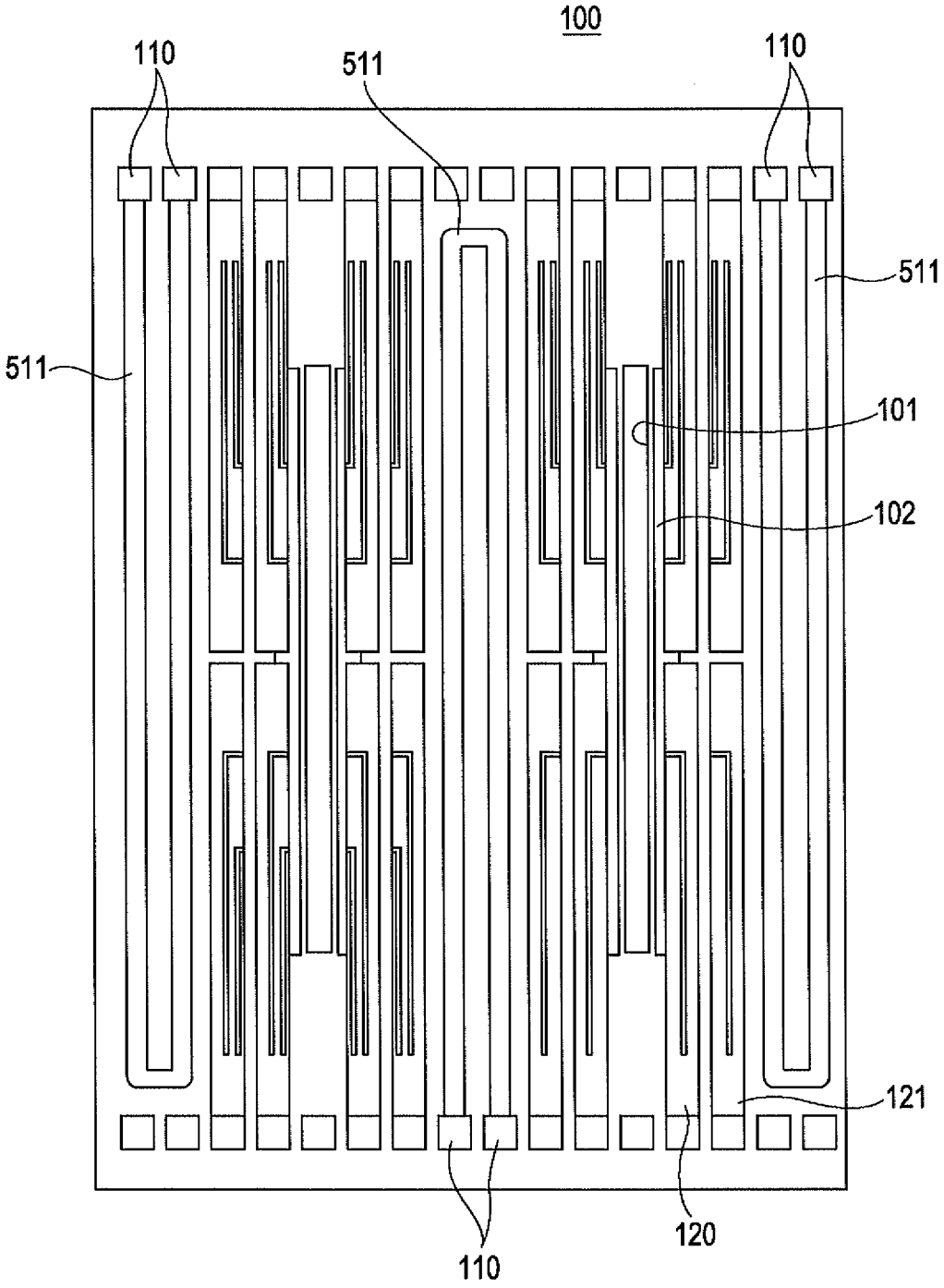
FIG. 12 is a plan view showing a layout of a conductive layer of a head substrate according to a second embodiment.

FIG. 12 shows a configuration which satisfies high durability for pre-heating with high current and for long-term use of the head.

Figure 14:
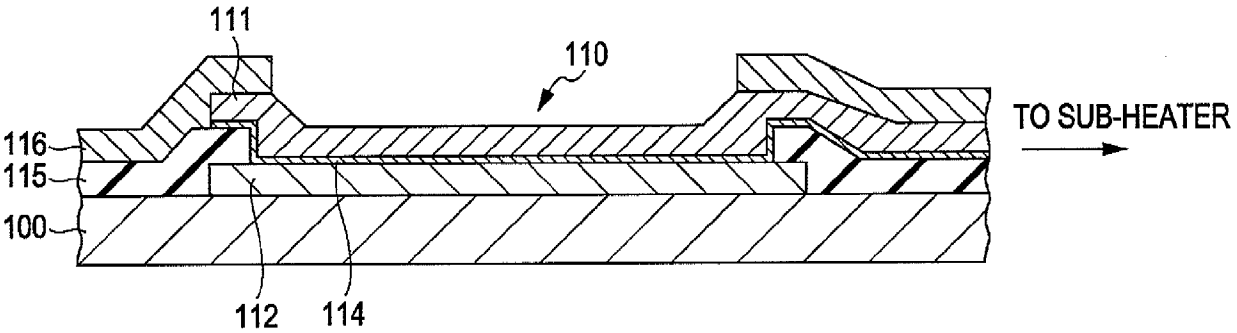
FIG. 14 is a cross-sectional view showing an external connection electrode of this embodiment.

In a head substrate 100 of this embodiment, sub-heaters 511 are formed by using the second conductive layer 111 in a manner similar to the VH power lines 120 and GNDH power lines 121. A plurality of the sub-heaters are separately arranged at positions on the head substrate 100. In addition, external connection pads 110 serving as external connection electrodes are provided at the head substrate 100. Each sub-heater is electrically connected to two external connection pads 110 at both ends of the sub-heater. FIG. 14 is a cross-sectional view of one of the external connection pad 110.

When a substrate temperature is a predetermined temperature or lower, an electric potential is applied to the external connection pad 110 through an inner lead of a TAB line 401 and hence current flows from the external connection pad 110. Referring to FIG. 14, a surface of the external connection pad 110 is formed of only the second conductive layer 111 of the sub-heater. Hence, at the external connection pad 110, the flow of electrons is not interrupted by the resistance layer 114, and the electrons flow through the second conductive layer 111. In addition, no connection portion is provided in the sub-heater for connecting the second conductive layer 111 to the first conductive layer 112. Current flows from the one external connection pad 110 only through the second conductive layer 111 to the other external connection pad 110. Accordingly, the sub-heater generates heat, and pre-heating is performed to increase the temperature of the head substrate 100 to a predetermined temperature. After the temperature of the head substrate 100 is increased, the application of voltage to the sub-heater is decreased. Then, the temperature of the head substrate 100 is controlled to be kept constant.

As described above, in this embodiment, a connection portion for connecting the first conductive layer 112 and the second conductive layer 111 is not provided. Hence, electromigration can be avoided. Accordingly, even when a head is used with high current for a long period, a damage of the sub-heater because of electromigration can be prevented, and reliability can be increased. In some cases, a head for industrial use is used constantly at a high temperature depending on the characteristic of liquid. Also, the head for industrial use has to operate for a long period. For such a head for industrial use, the configuration of this embodiment is effective.

In this embodiment, the length of the sub-heater is increased by folding the sub-heater one time within the head substrate. However, the sub-heater may be desirably arranged depending on necessary power and life of the sub-heater. As long as only the second conductive layer is used, a straight line may be provided to extend from one end to the other end of the head substrate. Also, the number of folding times of the sub-heater is not limited to one, and the sub-heater may be folded a plurality of times.

Figure 15:
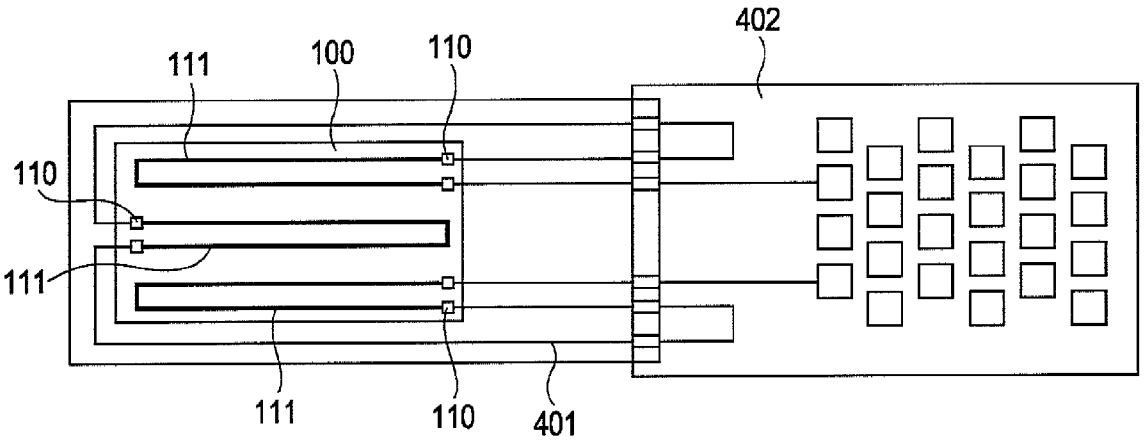
FIG. 15 is a wiring diagram of a sub-heater according to the second embodiment.

To further increase the EM durability, using the head substrate shown in FIG. 12, a head substrate shown in FIG. 15 may be mounted on a head.

This head substrate 100 has line sections respectively extending from external connection pads 110 of second conductive layers 111 of three independent sub-heaters, through a TAB line 401, to a printed wiring board 402 located outside the head substrate 100. The line sections extending from the external connection pads 110 of the second conductive layers 111 are electrically connected to the printed wiring board 402 such that the three sub-heaters are arranged in series.

As described above, by using only the second conductive layer for the sub-heater and folding the sub-heater, a long length of the wiring line can be provided, and the current density can be decreased. Thus, the sub-heater with a reduced EM durability can be provided on the substrate.

Further, the long sub-heater is provided along the supply port in an area between the adjacent supply ports and areas between the supply ports and the edges of the substrate. With the sub-heater as described above, the temperature distribution in the substrate can be evenly kept in the array direction of the heaters. Thus, discharge characteristic of liquid (ink) can be equalized, and recording quality can be increased.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-221494 filed Aug. 29, 2008, which is hereby incorporated by reference herein in its entirety.

What is claimed is:

1. A method of manufacturing a liquid-discharge-head substrate having a plurality of elements, the elements being configured to generate energy for discharging liquid and being arranged to form an element array, the method comprising the steps of:

preparing a substrate having a first heating line member, an insulating layer on or above the first heating line member and a conductive layer on or above the insulating layer, the insulating layer being made of an insulating material and the first heating line member and the conductive layer being made of a conductive material; and patterning the conductive layer to form a conductive line and a second heating line member, the conductive line being configured to supply current for driving the elements, the first and second heating line members being electrically separated from the conductive line and configured to generate heat for heating the liquid-discharge-head substrate, a longitudinal direction of the second heating line member extending along the conductive line and the element array, and a longitudinal direction of the first heating line member extending along a direction intersecting with the conductive line;

wherein the first heating line member and the second heating line member are electrically connected through a through hole formed in the insulating layer, and wherein the second heating line member is longer than the first heating line member.

2. The method according to claim 1, further comprising:

providing a further conductive layer above a surface of the substrate; and forming a drive circuit line and the first heating line member by using the further conductive layer, the drive circuit line being connected to a drive circuit, and the drive circuit being configured to control driving of the element.

3. The method according to claim 1, further comprising the step of:

providing a material with a higher electric resistance than the conductive layer for forming the element, as a continuously arranged layer extending from a position on the insulating layer corresponding to the removed part of the conductive line to positions on the first line portion and the second line portion.

4. The method according to claim 1, wherein the conductive layer contains aluminium.

5. The method according to claim 1, wherein the second heating line member is parallel to the element array.

6. The method according to claim 1, wherein in the step of preparing the substrate, the substrate has a resistance layer on the insulating layer and the conductive layer on the resistance layer.

7. The method according to claim 6, wherein the resistance layer contains tantalum and nitrogen.

8. The method according to claim 6, further comprising removing a part of the conductive line, thereby dividing the conductive line into a first line portion and a second line portion separated from the first line portion, and defining an area of the resistance layer corresponding to the removed part of the conductive line as an element of the plurality of the elements.

9. The method according to claim 1, wherein the elements generate thermal energy.

10. The method according to claim 1, wherein a part of the first heating line member overlaps a part of the conductive line in a direction of stacking layers.

11. The method according to claim 1, wherein the second heating line member is longer than the element array.

12. The method according to claim 1, wherein the first heating line member extends along a direction intersecting with the element array.

* * * * *